US005381881A

United States Patent [19]

Meyer et al.

[11] Patent Number: 5,381,881

[45] Date of Patent: Jan. 17, 1995

[54] STEP PLATFORM FOR AN ESCALATOR

[75] Inventors: Helmut J. W. Meyer, Bueckeburg; Hermann W. Ahls, Obernkirchen OT Vehlen; Klaus Blaseck, Burgdorf-Ehlershausen; Udo Schmitting, Schwafoerden, all of Germany

[73] Assignee: Otis Elevator Company, Farmington, Conn.

[21] Appl. No.: 151,440

[22] Filed: Nov. 12, 1993

[51] Int. Cl.[6] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 4,557,369 | 12/1985 | Ishida et al. | 198/333 |
| 4,569,433 | 2/1986 | Ishida et al. | 198/333 |
| 4,681,207 | 7/1987 | Goto et al. | 198/333 |
| 5,062,519 | 11/1991 | Haruta | 198/333 |
| 5,295,569 | 3/1994 | Kubota | 198/333 |

FOREIGN PATENT DOCUMENTS

| | | |
|---|---|---|
| 64-11556 | 7/1982 | Japan . |
| 59-230985 | 6/1983 | Japan . |
| 60-23285 | 7/1983 | Japan . |
| 1-119253 | 6/1984 | Japan . |
| 60-52487 | 3/1985 | Japan . |
| 4-209194 | 7/1992 | Japan . |
| 4-209195 | 7/1992 | Japan . |

OTHER PUBLICATIONS

Escalator Modification for the Handicapped by Foster-Miller Associates, Inc., Jul. 1980.

*Primary Examiner*—Cheryl L. Gastineau

[57] ABSTRACT

A step platform for an escalator having a step chain with a plurality of axles is provided comprising a lower step attached to an axle of the step chain, a higher step, attached to an axle of the step chain, having a middle section, and apparatus for actuating the middle section. The actuating apparatus is operated by the rotation of the step chain axles in the transition zones between the landings and the inclined midsection of the escalator.

20 Claims, 7 Drawing Sheets fig.8A
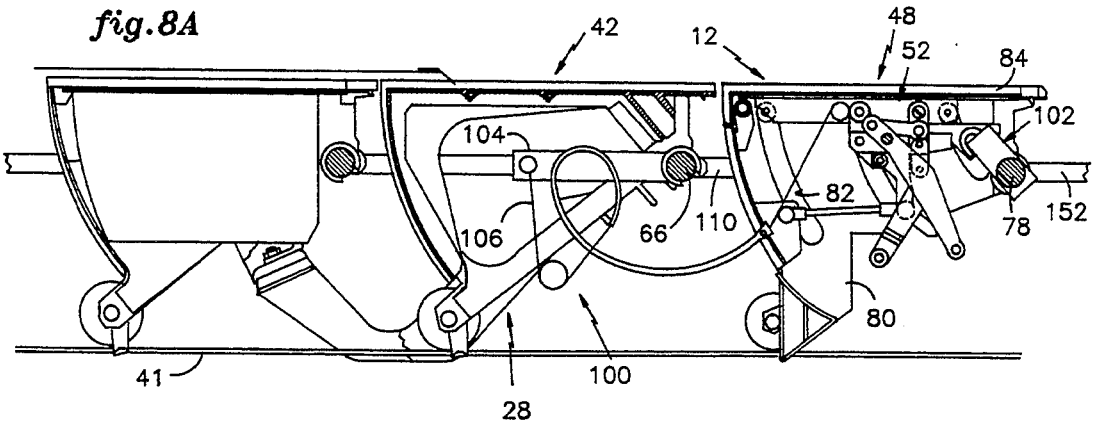
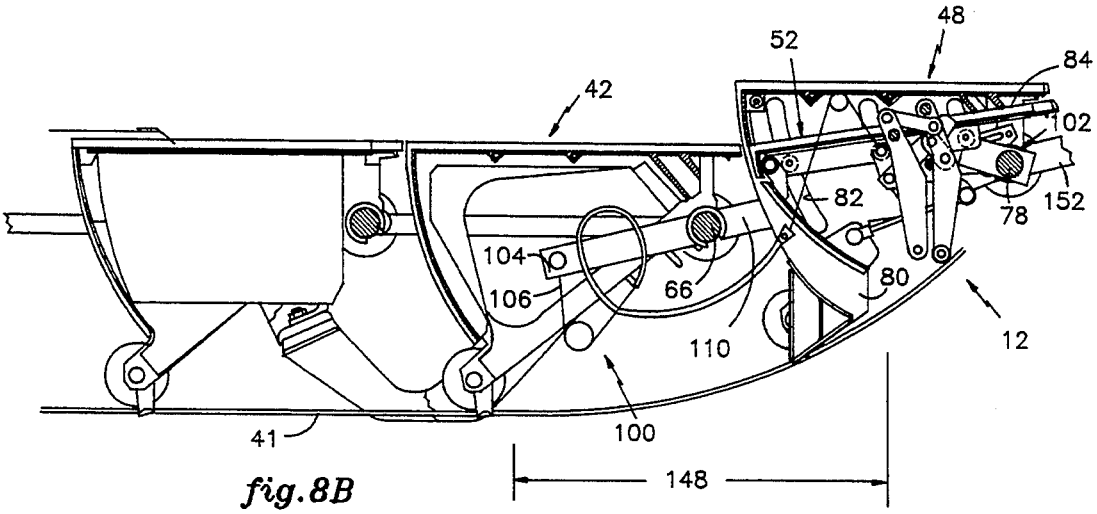
fig.8B
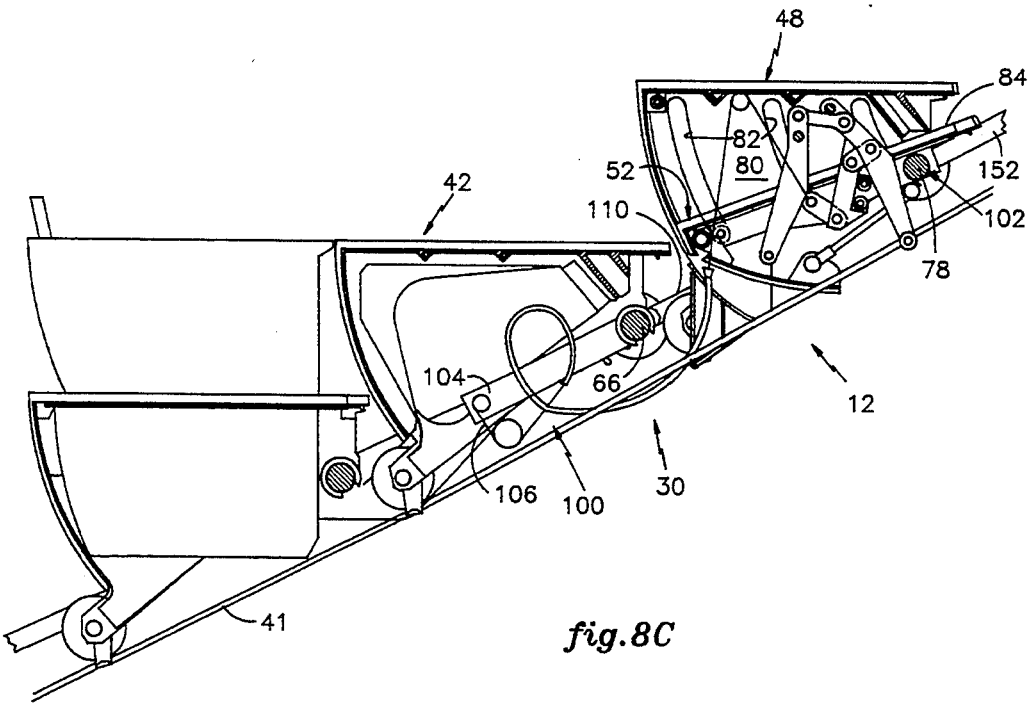
fig.8C

STEP PLATFORM FOR AN ESCALATOR

TECHNICAL FIELD

This invention relates to escalators in general, and to step platforms for handicap adapted escalators in particular.

BACKGROUND ART

Escalators and elevators are two of the most popular means for moving pedestrian traffic from a first elevation to a second elevation. Elevators are typically used when the rise is greater than two floors, and the passenger volume light to moderate. Escalators, in contrast, are typically used when the rise is three floors or less and the passenger volume moderate to heavy. It is very common today for existing buildings to have both escalators and elevators, thereby capitalizing on the advantages of both.

Historically, handicapped pedestrian traffic has been limited to elevators because of the inability of escalators to accept handicapped passengers, in particular those in wheelchairs. Handicap access in existing buildings has been provided, therefore, by having either elevators alone or by having elevators in addition to escalator elevators. Today, however, the trend in almost all types of buildings is towards less expensive two and three story buildings which can be operated more efficiently. The cost of installation and maintenance, coupled with the unrentable occupied space, make providing both escalators and elevators a less popular option than in the past. Passenger traffic and handicap access must still be satisfied, however.

DISCLOSURE OF THE INVENTION

It is, therefore, an object of the present invention to make escalators handicap accessible.

It is a further object of the present invention to provide a step platform for an escalator.

It is a further object of the present invention to provide a step platform for an escalator which can be retracted when not in use, thereby allowing the escalator to operate in a normal mode.

It is a still further object of the present invention to provide a step platform for an escalator which may be retrofit on to existing escalators.

According to the present invention, a step platform is provided for an escalator having a step chain with a plurality of axles. The step platform comprises a lower step attached to an axle, a higher step attached to an axle, a middle section mounted in the higher step, and means for actuating the middle section. The actuating means is operated by the rotation of the axles in the transition zones between the landings and the inclined midsection of the escalator.

According to one aspect of the present invention, the actuating means comprises a first actuator that is operated by the rotation of the axle attached to said lower step in the transition zones between the landings and the inclined midsection. According to another aspect of the present invention, the actuating means comprises a second actuator that is operated by the rotation of the axle attached to the higher step in the transition zones between the landings and the inclined midsection.

According to still another aspect of the present invention, means for selectively maintaining the middle section in a normal, unactuated position is provided.

According to still another aspect of the present invention, the middle section may be positioned completely below the top of the main body of the step.

An advantage of the present invention is that the present invention provides a step platform which enables handicapped passengers to utilize an escalator.

A further advantage of the present invention is that the present invention provides a step platform that is an integral part of the escalator. As a result, all the equipment that is necessary to utilize the step platform is present at the escalator. In some prior art wheelchair accessible escalators, an external piece of equipment is necessary to utilize the step platform and, therefore, may or may not be accessible at the moment desired.

A still further advantage of the present invention is that the step platform may be installed as a retrofit on existing escalator units.

A still further advantage of the present invention is that in the lowered position, the middle section is completely below the top of the main body of the higher step. This position provides more room for the passenger and his or her equipment, compared to some prior art solutions which pivot the middle section on the top surface at the rear of the step.

These and other objects, features and advantages of the present invention will become more apparent in light of the detailed description of the best mode embodiment, thereof, as illustrated in the accompanying drawings.

DETAILED DESCRIPTION OF THE DRAWINGS

FIG. 6B includes several cutaways, to better illustrate the claimed invention.

FIGS. 8A–8C are sequential diagrammatic side views of the step platform traveling between the lower landing and the inclined midsection.

BEST MODE FOR CARRYING OUT THE INVENTION

I. Environment

Figure 1:
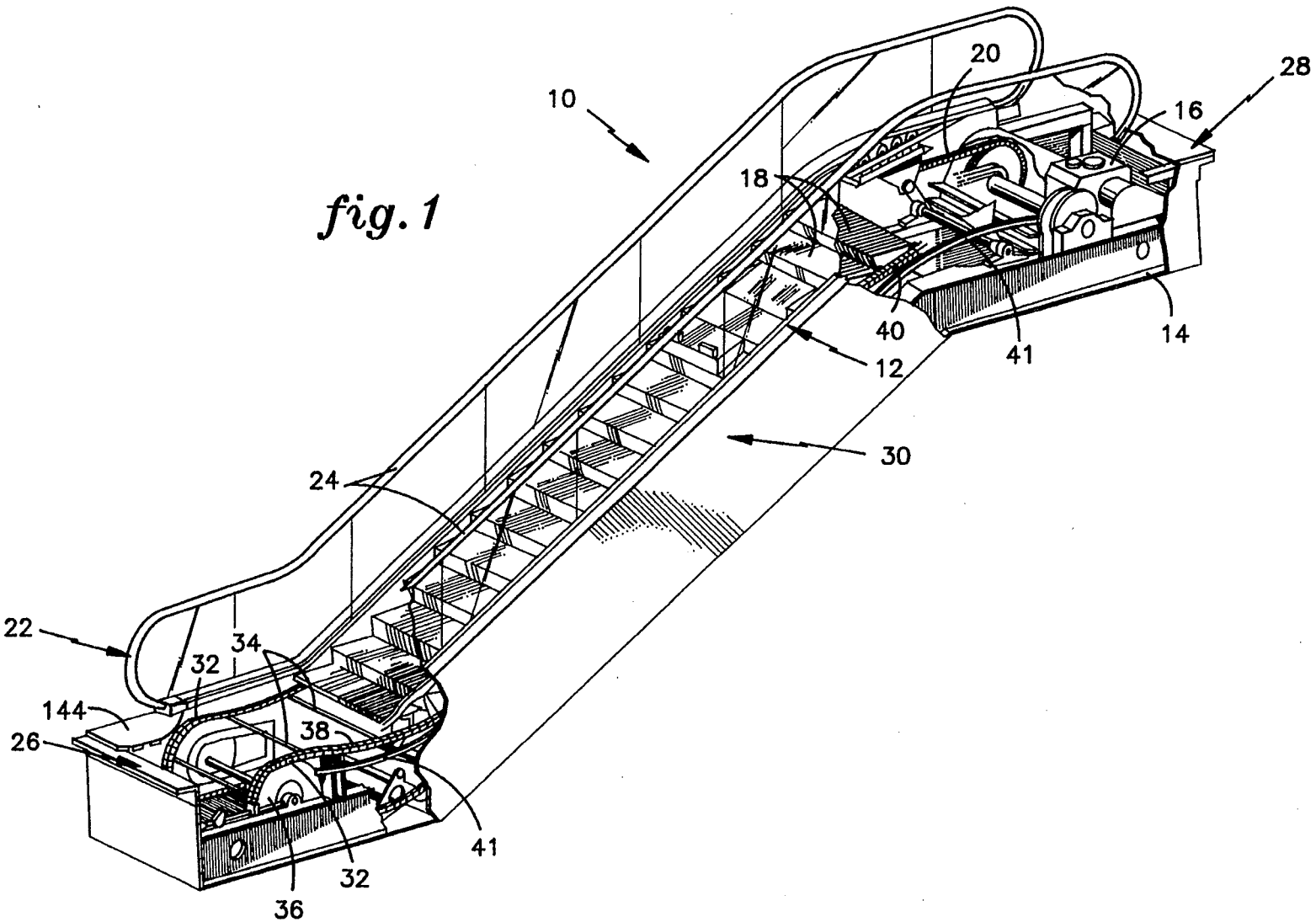
FIG. 1 is a diagrammatic view of an escalator.

Now referring to FIG. 1, an escalator 10 utilizing the step platform 12 of the present invention, is shown having a frame 14, a drive 16, a plurality of steps 18 attached to a step chain 20, and a pair of balustrades 22 for guiding a pair of handrails 24. The frame 14 includes a lower landing 26, an upper landing 28, and an inclined midsection 30 therebetween. The step chain 20, comprising two strands 32 connected by a plurality step axles 34, travels a circuitous path within the frame 14, reversing direction around a sprocket assembly 36 in each landing. The strands 32 comprise a plurality of links 38 which are pivotly attached to one another. Each step 18 is pivotly attached to a step axle 34 and includes rollers 40 for contact with a pair of roller tracks 41 fixed to the frame 14.

a. The Step Platform

Figure 2:
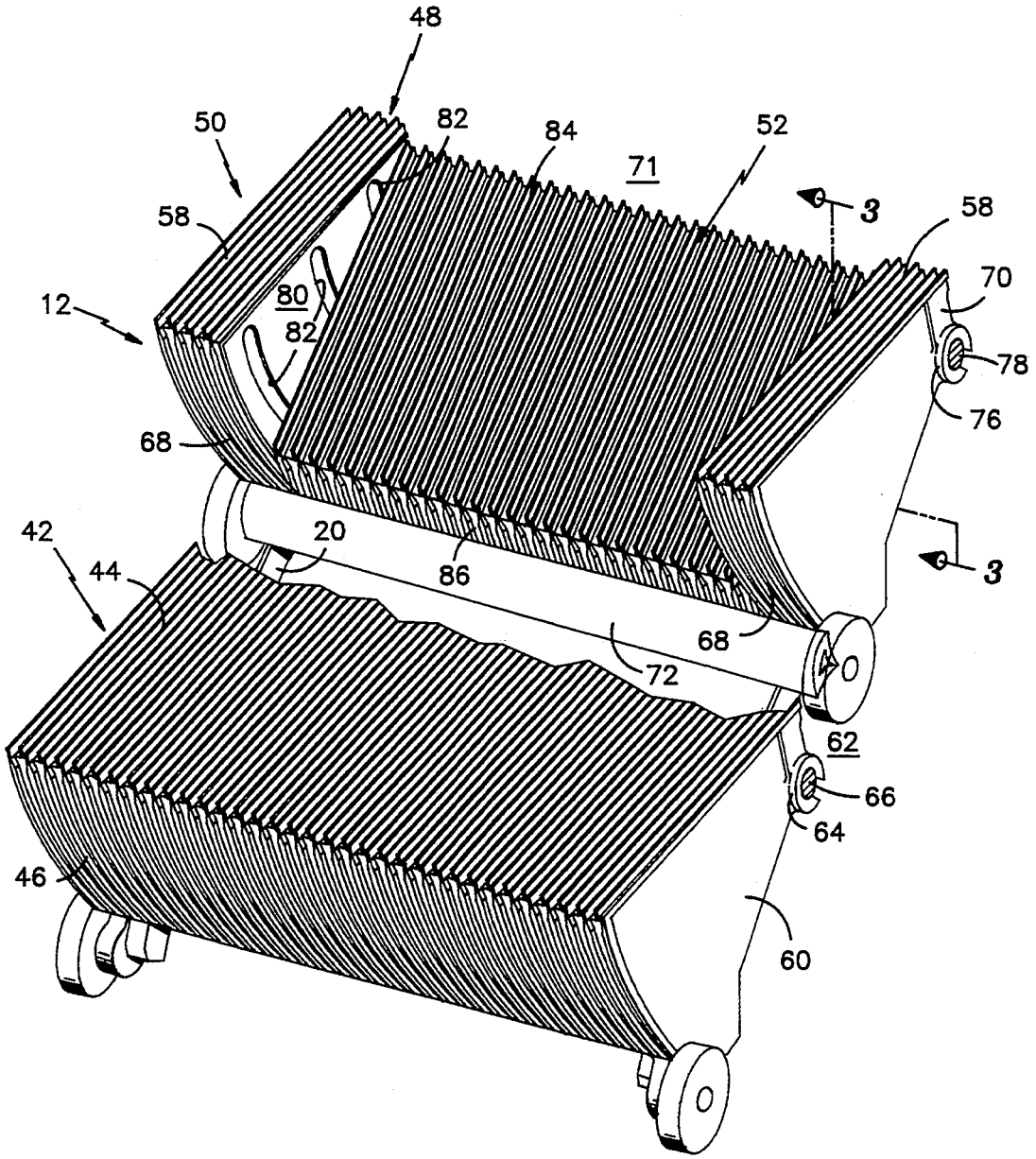
FIG. 2 is a diagrammatic side view of the step platform.

Referring to FIG. 2, the step platform 12 includes a lower step 42 having a top 44 and a riser 46, a higher step 48 having a main body 50 and a middle section 52, and means 54 (not shown—see FIGS. 4A, 4B, 5, and 8A–8C) for actuating the middle section 52.

The top 44 and the riser 46 of the lower step 42 are attached to a step frame 60. At the rear 62 of the lower step 42, the step frame 60 includes a pair of yokes 64 for attaching the step 42 to a step axle 66 of the step chain 20.

The main body 50 of the higher step 48 includes a top 58 and a riser 68 attached to a step frame 70. The step frame 70 includes a triangular shaped member 72 which extends across the step 48, thereby connecting the top 58 and riser 68 sections on both sides of the middle section 52. At the rear 71 of the higher step 48, the step frame 70 includes a pair of yokes 76 for attaching the step 48 to a step axle 78. A pair of slotted guide plates 80 are attached to the main body 50, adjacent the middle section 52. In the preferred embodiment, each guide plate 80 includes three curvilinear slots 82. The guide plates 80 may alternatively have more or less slots in different geometries.

Figures 3A, 3B, 3C:
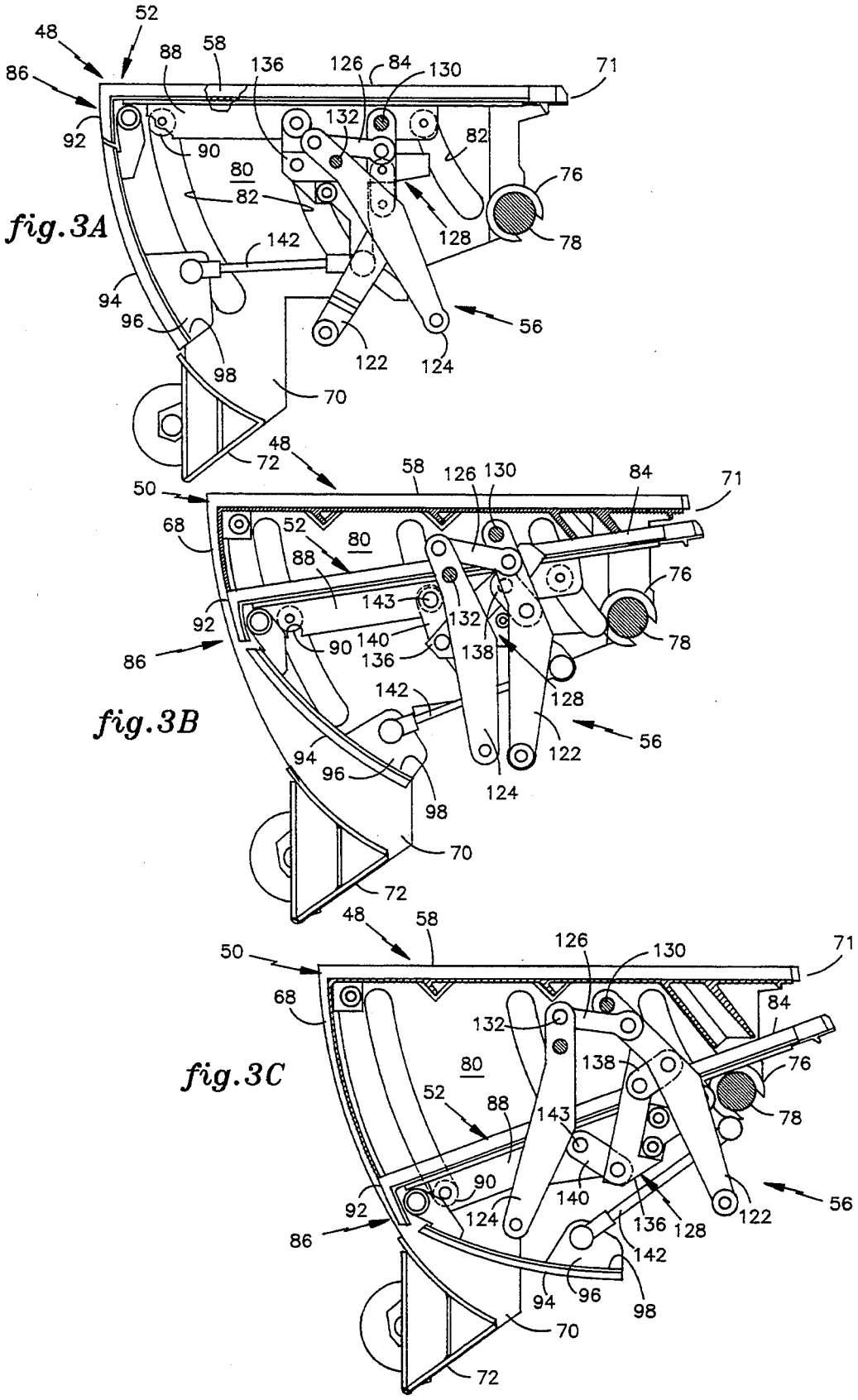
FIG. 3A is a diagrammatic sectional view of the higher step shown in FIG. 2, with the middle section in the normal, unactuated position.
FIG. 3B is a diagrammatic sectional view of the higher step shown in FIG. 2, with the middle section in between the normal, unactuated position and the lowered, actuated position.
FIG. 3C is a diagrammatic sectional view of the higher step with the middle section in the lowered, actuated position.

Referring to FIGS. 3A–3C, the middle section 52 also includes a top 84 and a riser 86 (see also FIG. 2). The top 84 comprises a pair of flanges 88 extending out from beneath the top 84, only one of which is shown for ease of illustration. Guide rollers 90 are attached to each flange 88, spaced apart from one another to align with the curvilinear slots 82 in the guide plates 80. A first part 92 of the middle section riser 86 is rigidly attached to the lowerable section top 84. A second part 94 of the middle section riser 86 is pivotly attached beneath the top 84. The second part 94 includes a pair of flanges 96 extending out from an inside surface 98 of the riser 86.

b. Means for Actuating the Middle Section of the Higher Step

Figure 4A:
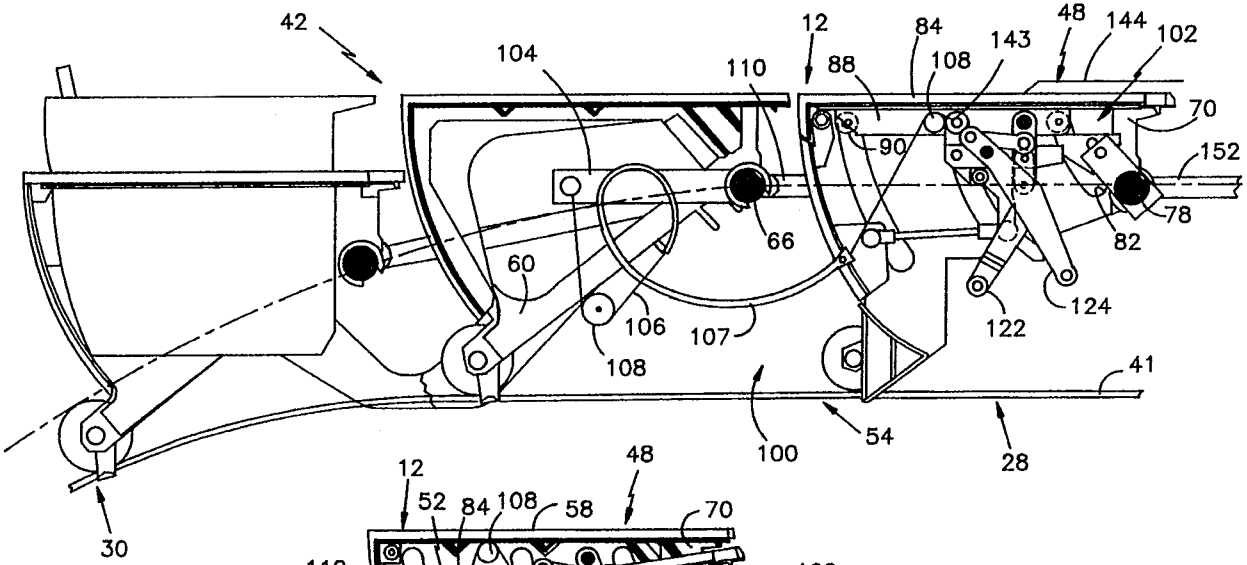
FIGS. 4A and 4B are sequential diagrammatic side views of the step platform traveling between the higher landing and the inclined midsection.
Figure 4B:
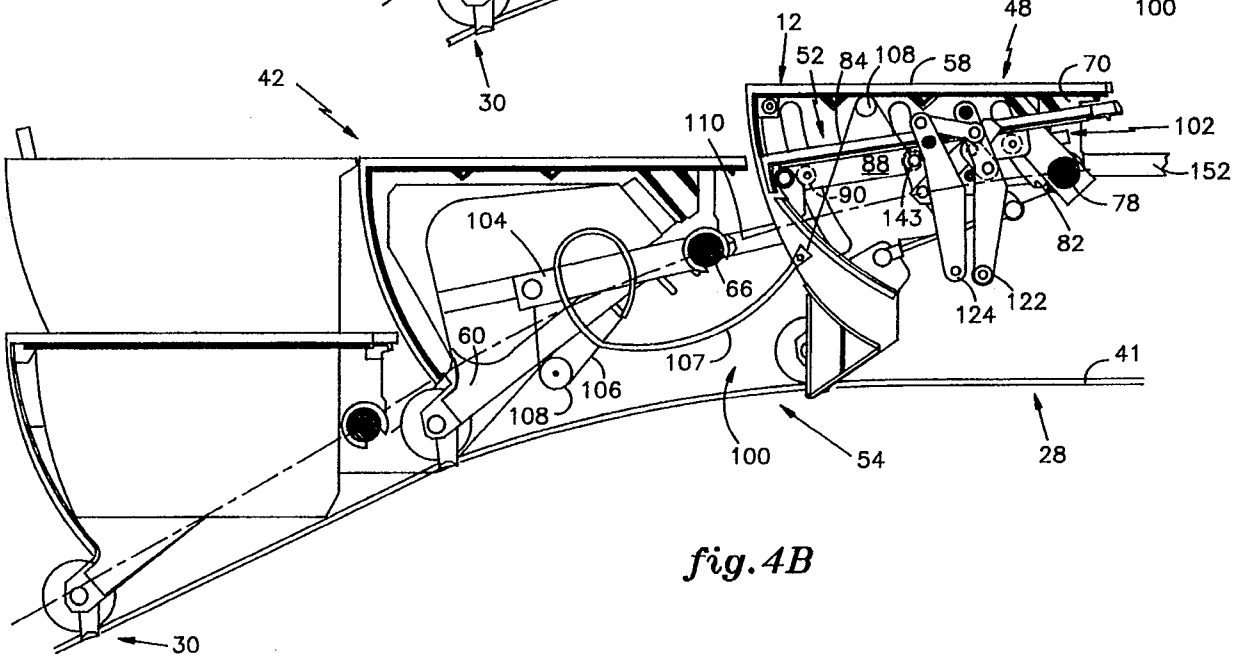
Figures 5, 7:
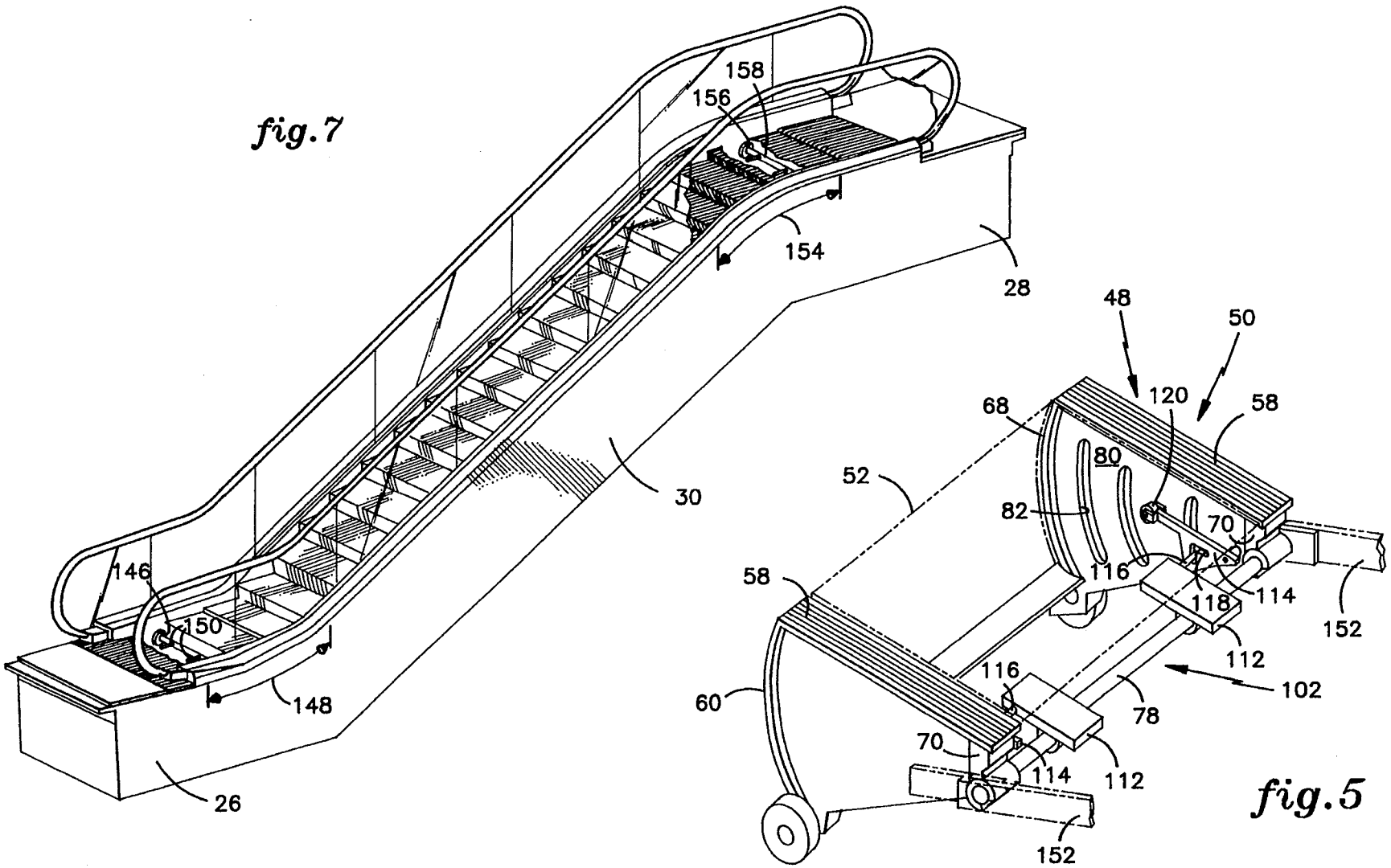
FIG. 5 is a partial view of the higher step shown in FIG. 2, showing the second actuator.
FIG. 7 is a diagrammatic view of an escalator showing the means for actuating the step platform.

Referring to FIGS. 4A and 4B, the means 54 for actuating the middle section 52 includes a first actuator 100 and a second actuator 102 (see also FIG. 5). The first actuator 100 includes a pair of arms 104, a pair of sheathed cables 106, and a plurality of pulleys 108. The arms 104 are fixed to the step axle 66 to which the lower step 42 is attached, hereinafter referred to as the lower step axle 66. The lower step axle 66, in turn, is fixed to the step chain links 110 extending out from the lower step 42 in the direction of the higher step 48.

The sheaths 107 containing the cables 106 are attached to, and extend between, the frame 60 of the lower step 42 and the frame 70 of the higher step 48. The cables 106, which travel within the sheaths, are attached to the arms 104 and to a pair of rods 143 extending out from the middle section 52. Specifically, the rods extend out from the flanges 88 attached to the middle section 52, through the center slot 82 in the respective guide plate 80, and attach to linkages housed within main body 50 as will be discussed infra.

Referring to FIG. 5, the second actuator 102 includes a pair of first arms 112 and a pair of second arms 114. The first arms 112 are fixed to the step axle 78 to which the higher step 48 is attached, hereinafter referred to as the higher step axle 78. Each first arm 112 has a pin 116 extending out from the arm 112, parallel to the step axle 78. The second arms 114 are pivotly attached to the step frame 70 of higher step 48. Each second arm 114 includes a slot 118 for receiving the pin 116 extending out from the first arm 112 and a roller 120 attached to the end of the arm 114 opposite the end attached to the step frame 70.

c. Means for Selectively Maintaining Top of Middle Section in Same Plane as Main Body Top.

Referring to FIGS. 3A–3C, a means 56 for selectively maintaining the middle section top 84 in the same plane as the main body top 58 is provided. To facilitate explanation of the maintaining means 56, see FIGS. 6A and 6B for an enlarged view of the maintaining means 56 shown in FIG. 3A. The maintaining means 56 comprises a first 122 and second 124 engagement arm, a first link 126, and a linkage means 128 for connecting the first engagement arms 122 to the middle section 52 on each side of the middle section 52 as will be discussed infra.

The first 122 and second 124 engagement arms are pivotly attached to the step frame 70 of the higher step 48 on each side of the middle section 52. A person of skill in the art will recognize that the maintaining means 56 shown in FIGS. 3A–3C, 4A, 4B, 6A, 6B, and 8A–8C are shown along the sectional line depicted in FIG. 2. Accordingly, the side of the main body 50 to which the maintaining means 56 is attached, and the guideplate 80 on that side, are removed to expose the means 56 for illustrative purposes.

Figure 6A:
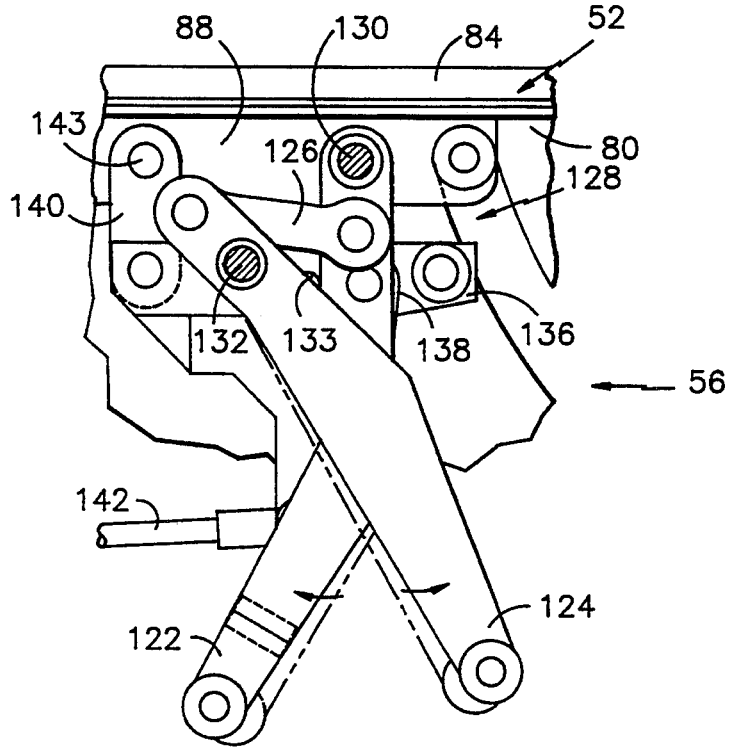
FIG. 6A and 6B are enlarged views of the selective maintaining means shown in FIG. 3A.
Figure 6B:
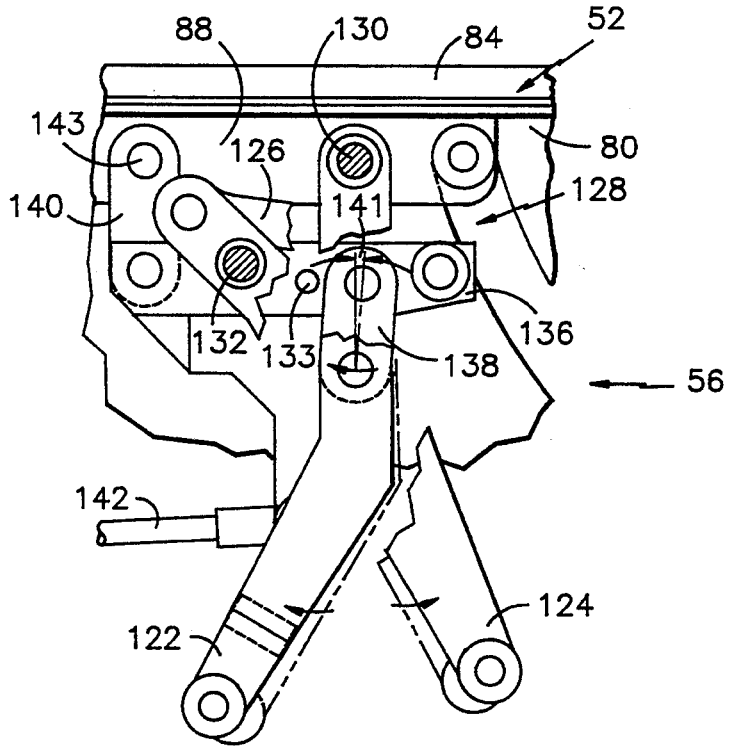

Referring to FIGS. 6A and 6B, the first engagement arms 122 are mounted to pivot about one end 130, and the second engagement arms 124 are mounted to pivot about a point 132 located a distance from an end. The first links 126 pivotly connect both pairs of engagement arms 122, 124, such that rotating one engagement arm 122, 124 in one direction will cause the other engagement arm 124, 122 to rotate in the opposite direction.

Each linkage means 128 comprises a center plate 136, a second link 138, and a third link 140. The second link 138 is pivotly attached to the first engagement arm 122 on one end and to the center plate 136 on the other end. The third link 140 is pivotly attached to the center plate 136 on one end and to the middle section 52 on the other end, via axle 143. Axle 143 extends out from the flange 88 underneath the middle section 52 and through the center slot 82 of the guide plate 80. The third link 140 is pivotly attached to the axle 143 on the side of the guide plate 80 opposite the middle section 52 (In FIGS. 3A–3C, 4A, 4B, 6A, 6B, and 8A–8C, guide plate 80 is not shown on the side of the middle step 52 where maintaining means 56 is shown for illustrative purposes).

Referring to FIGS. 3A–3C, an adjustable rod 142 attaches the center plate 136 to the flange 96 extending out from the riser 86 of the middle section 52.

Referring to FIGS. 6A and 6B, a pin 133 extends out from the center plate 136 into the path of the first engagement arm 122.

d. Means for Actuating the Step Platform

Referring to FIG. 7, a rotational motion first solenoid 146 is positioned in the lower landing 26 adjacent the transition zone 148 between the lower landing 26 and the inclined midsection 30. A first mechanical structure 150 is in register with the solenoid 146 and may be rotated by the solenoid 146. A rotational motion second solenoid 156 is positioned in the upper landing 28 adjacent the transition zone 154 between the upper landing 28 and the inclined midsection 30. A second mechanical structure 158 is in register with the solenoid 156 and may be rotated by the solenoid 156.

II. Operation

Referring to FIG. 1, in the operation of the escalator 10, the step chain 20 and attached steps 18 travel circuitously from the lower landing 26, up the inclined midsection 30, through the upper landing 28 and back down to the lower landing 26. In the lower landing 26, the step chain 20 and attached steps 18 change direction around a sprocket assembly 36 and subsequently travel out from underneath a combplate 144 (see also FIG. 4A). Underneath the combplate 144 and for a distance thereafter, the roller tracks 41 of the escalator 10 maintain the tops of the steps 18 in a single level plane.

a. Normal Mode of Operation

Referring to FIG. 1 in the normal mode of operation, it is known when each step 18 begins to enter the inclined midsection 30 from the lower landing 26, the curvature of the roller track 41 causes each step 18 to rise above the step 18 following it. When the curvature of the roller track 41 becomes linear within the inclined midsection 30, all of the steps 18 within the inclined midsection 30 are maintained at a similar difference in height by the roller tracks 41. As each step 18 enters the upper landing 28, the process reverses and the steps 18 return to having their tops in the same plane as one another. Subsequently, the steps 18 rotate around the sprocket assembly 36 in the upper landing 28 and return towards the lower landing 26.

Referring to FIG. 3A, in the normal mode of operation the selective maintaining means 56 maintains the top 84 of the middle section 52 in the same plane as the top 58 of the main body 50. In this position, the linkage means 128 lies in a detent position. Referring to FIGS. 6A and 6B, the detent position is encountered when the first engagement arm 122 rotates the second 138 link a predetermined amount 141 past vertical (see FIG. 6B), into contact with the pin 133 extending out from the center plate 136. In this position, the weight of the middle section 52 biases the first engagement arm 122 against the pin 133, thereby maintaining the middle section 52 in a normal, unactuated position. In the normal position, the middle section top 84 is coplanar with the main body top 58 (not shown). In the preferred embodiment, the second link 138 is rotated five degrees past vertical when it contacts the pin 133. A person of ordinary skill in the art will recognize, however, that other positions past vertical may alternatively be chosen. The phantom lines in FIGS. 6A and 6B depict the first 122 and second 124 engagement arms in the vertical position.

b. Actuated Mode of Operation i.) Escalator steps traveling from the lower landing to the upper landing, up the incline;

Referring to FIG. 7, when a passenger requires the step platform 12 (see FIG. 2) while traveling from the lower landing 26 to the upper landing 28, he, she, or an attendant, pushes a call button or switch (not shown). The call button signals a first solenoid 146, positioned at the beginning of the transition zone 148 between the lower landing 26 and the inclined midsection 30, to actuate a first mechanical structure 150 into the path of the second engagement arms 124 (see FIGS. 3A–3C). Referring to FIGS. 3A–3C, the second engagement arms 124 are subsequently rotated out of the detent position by contact with the first mechanical structure 150 as the higher step 48 passes by and enters the transition zone 148. FIGS. 3A–3C do not show the first mechanical structure 150 contacting the second engagement arm 124. They do, however, show the engagement arms 122, 124 in sequential motion, as if contacted by the structure 150.

Referring to FIGS. 8A–8C, when the higher step 48 enters the transition zone 148, the second actuator 102 is set into motion by the rotation of the higher step axle 78. The rotation occurs when the step chain links 152 preceding the higher step axle 78, which are fixed to the axle 78, encounter the ascending curvature of the roller tracks 41 in the transition zone 148 (FIG. 8B). The rotation of the higher step axle 78 continues until the higher step 48 is completely in the linear slope of the inclined midsection 30 (FIG. 8C).

Referring to FIG. 5, rotating the higher step axle 78 rotates the first arms 112 of the second actuating means 102 which are fixed to the higher step axle 78. The pins 116 extending out from the first arms 112, in turn, rotate the second arms 114 away from the middle section 52.

Referring to FIGS. 3A–3C, when the first mechanical structure 150 (see FIG. 7) moves the first engagement arms 122, other elements of the selective maintaining means 56 are also moved. Specifically, the rotating first engagement arms 122 rotate the pivotly connected second engagement arms 124 in the opposite direction. The first engagement arms 122 also rotate the linkage means 128. At this point in time, the support of the middle section 52 has transferred from the selective maintaining means 56 to the cables 106 of the first actuating means 100 (see FIGS. 8A–8C).

Referring to FIGS. 8A–8C, as the lower step 42 subsequently enters the transition zone 148 (FIG. 8B) between the lower landing 26 and the inclined midsection 30, the step chain links 110 fixed to the lower step axle 66 continue to pivot, thereby rotating the lower step axle 66 and the arms 104 of the first actuating means 100. Rotating the arms 104 of the first actuating means 100 in one direction pays out the cables 106 relative to the middle section 52, and in the other direction draws the cables 106 in relative to the middle section 52. Hence, the motion of the middle section 52 while the step platform 12 travels from the lower landing 26 into the inclined midsection 30 is a function of the rotation of the lower step axle 66. The geometry of the slots 82 in the guide plates 80, however, determines the exact path taken by the middle section 52. At the same time, the linkage means 128 rotates and tucks the connected middle section riser 86 under the middle section 52, via the adjustable rod 142.

Referring to FIGS. 4A and 4B, when the step platform 12 enters the transition zone 154 between the inclined midsection 30 and the upper landing 28, the higher step axle 78 rotates the second actuator 102 into contact with the top 84 of the middle section 52. As the higher step 48 travels further into the transition zone 154, the second actuator 102 raises the middle section 52 up until the middle section top 84 is in the same plane as the main body top 58 (FIG. 4B).

Referring to FIG. 5, the second actuator 102 raises the middle section 52, shown in phantom, in the following manner. The rotation of the higher step axle 78 causes the attached first arms 112 to rotate toward the middle section 52. The pins 116, in turn, actuate the second arms 114 toward the middle section 52. As a result, the second arms 114 contact and move the middle section 52 upward.

Referring to FIGS. 3A–3C, and FIG. 7, at this point, the second solenoid 156 (FIG. 7) actuates a second mechanical structure 158 (FIG. 7) into the path of the first engagement arm 122. As the first engagement arm 124 passes and contacts the second mechanical structure 158 (FIG. 7), the engagement arms 122, 124 rotate back into the detent position and support of the middle section 52 is transferred back to the selective maintaining means 56.

ii.) Escalator steps traveling from the upper landing to the lower landing, down the incline;

Referring to FIG. 7, when a passenger requires the step platform 12 (see FIG. 2) while traveling from the upper landing 28 to the lower landing 26, he or she or an attendant, pushes a call button or switch (not shown). The call button signals the second solenoid 156, positioned at the upper landing side of the transition zone 154 between the upper landing 28 and the inclined midsection 30, to actuate the second mechanical structure 158 into the path of the first engagement arms 122.

Referring to FIGS. 4A and 4B, before the first engagement arm 122 is contacted, however, the lower step 42 enters the transition zone 154 between the upper landing 28 and the inclined midsection 30, thereby rotating the lower step axle 66. The rotation of the lower step axle 66 and attached arms 104 of the first actuating means 100 pays out the cables 106 of the first actuating means 100 relative to the middle section 52. The first engagement arms 122 subsequently contact the second mechanical structure 158 (see FIG. 7) and rotate out of the detent position as the higher step 48 enters the transition zone 154.

At substantially the same time, the second actuating means 102 is actuated by the rotation of the higher step axle 78. The rotation occurs when the step chain links 152 now following the higher step axle 78, which are fixed to the axle 78, encounter the descending curvature of the roller tracks 41 in the transition zone 154. The rotation of the higher step axle 78 continues until the higher step 48 is completely in the linear slope of the inclined midsection 30.

Referring to FIG. 5, rotating the higher step axle 78 also rotates the first arms 112 of the second actuating means 102 which are fixed to the higher step axle 78. The pins 116, in turn, rotate the second arms 114 in a direction away from the middle section 52. Referring to FIGS. 4A and 4B, the second arms 114 support the middle section 52 until either the rollers 90 attached to flanges 88 bottom out within the slots 82 of the guide plates 80 or the slack is completely taken out of the cables 106 of the first actuating means 100.

Referring to FIGS. 8A–8C, when the step platform 12 (see FIG. 2) enters the transition zone 148 between the inclined midsection 30 and the lower landing 26, the lower step axle 66 and the attached arms 104 of first actuating means 100 rotate, thereby drawing in the cables 106 relative to the middle section 52. As a result, the cables 106 raise the middle section 52 until the middle section top 84 is in the same plane as the main body top 58.

Referring to FIGS. 3A–3C and FIG. 7, at this point the first solenoid 146 (FIG. 7) actuates the first mechanical structure 150 (FIG. 7) into the path of the second engagement arms 124. As the second engagement arms 124 pass and contact the first mechanical structure 150 (FIG. 7) the engagement arms 122, 124 are rotated back into the detent position and support of the middle section 52 is transferred back to the selective maintaining means 56.

Although this invention has been shown and described with respect to the detailed embodiments thereof, it will be understood by those skilled in the art that various changes in form and detail thereof may be made without departing from the spirit and scope of the claimed invention.

We claim:

1. A step platform for an escalator having a step chain, with a plurality of axles, traveling a circuitous path between a lower landing and an upper landing, passing through an inclined midsection extending therebetween, comprising:

a lower step, attached to an axle of the step chain;

a higher step, attached to an axle of the step chain, having a middle section which includes a top and a riser; and means for selectively raising or lowering said middle section within said higher step, wherein said selective raising or lowering means is operated by the rotation of the step chain axles in the transition zones between the landings and the inclined midsection.

2. A step platform according to claim 1, wherein said higher step further comprises:

a main body, having a top and a riser; and means for selectively maintaining said middle section top in the same plane as said main body top.

3. A step platform for an escalator having a step chain, with a plurality of axles, traveling a circuitous path between a lower landing and an upper landing, passing through an inclined midsection extending therebetween, comprising:

a lower step, attached to an axle of the step chain;

a higher step, attached to an axle of the step chain, comprising a main body, having a top and a riser;

a middle section, having a top and a riser;

means for selectively maintaining said middle section top in the same plane as said main body top; and first actuating means for selectively raising or lowering said middle section within said main body, wherein said first actuating means is operated by the rotation of the step chain axle attached to said lower step in the transition zones between the landings and the inclined midsection.

4. A step platform according to claim 3, wherein said first actuating means comprises:

an arm, having a length, fixed to the step axle connected to said lower step; and a cable, extending between, and attached to, said arm and said middle section of said higher step;

wherein said arm rotates with the step axle connected to the lower step in the transition zones between the landings and the inclined midsection, thereby causing said cable to be one of either payed out or taken in relative to said middle section.

5. A step platform according to claim 3, further comprising:

second actuating means for selectively raising or lowering said middle section within said main body, wherein said second actuating means is operated by the rotation of the step chain axle attached to said higher step in the transition zones between the landings and the inclined midsection.

6. A step platform according to claim 5, wherein said second actuating means comprises:

a first arm, fixed to the step axle attached to the higher step, having a pin extending out from said first arm, parallel to the step axle; and a second arm, pivotly attached to the main body of the higher step, having a slot for receiving said pin of said first arm;

wherein rotation of the step chain axle attached to said higher step in the transition zones between the landings and the inclined midsection causes said first and second arms to rotate toward said middle section.

7. A step platform according to claim 4, further comprising:

second actuating means for selectively raising or lowering said middle section within said main body, wherein said second actuating means is operated by the rotation of the step chain axle attached to said higher step in the transition zones between the landings and the inclined midsection.

8. A step platform according to claim 7, wherein said second actuating means comprises:

a first arm, fixed to the step axle attached to the higher step, having a pin extending out from said first arm, parallel to the step axle; and a second arm, pivotly attached to the main body of the higher step, having a slot for receiving said pin of said first arm;

wherein rotation of the step chain axle attached to said higher step in the transition zones between the landings and the inclined midsection causes said first and second arms to rotate toward said inclined midsection.

9. A step platform according to claim 3, wherein said selective maintaining means comprises:

a first engagement arm, pivotly attached to said main body of said higher step;

a second engagement arm, pivotly attached to said main body of said higher step; and a first link, pivotly attached to said first and second engagement arms, such that rotating one of said engagement arms in a first direction causes the other of said engagement arms to rotate in the opposite direction; and linkage means for connecting said first engagement arm and said middle section.

10. A step platform according to claim 9, wherein said linkage means comprises:

a center plate;

an engagement arm link, pivotly mounted on a first end to said center plate, and to said first engagement arm on a second end; and a middle section link, pivotly mounted on a first end to said middle section, and to said center plate on a second end;

wherein said linkage means guides said middle section during motion; and wherein said linkage means may be rotated into a detent position where said middle section top is maintained in the same plane as said main body top.

11. A step platform according to claim 10, wherein said riser of said middle section is pivotly attached to said middle section top.

12. A step platform according to claim 11, wherein said linkage means further comprises an adjustable rod pivotly attached on a first end to said middle section riser, and on a second end to said center plate, wherein rotating said linkage means causes said middle section riser to pivot under said middle section.

13. A step platform according to claim 8, wherein said selective maintaining means comprises:

a first engagement arm, pivotly attached to said main body of said higher step;

a second engagement arm, pivotly attached to said main body of said higher step; and a first link, pivotly attached to said first and second engagement arms, such that rotating one of said engagement arms in a first direction causes the other of said engagement arms to rotate in the opposite direction; and linkage means for connecting said first engagement arm and said middle section.

14. A step platform according to claim 13, wherein said linkage means comprises:

a center plate;

an engagement arm link, pivotly mounted on a first end to said center plate, and to said first engagement arm on a second end; and a middle section link, pivotly mounted on a first end to said middle section, and to said center plate on a second end;

wherein said linkage means guides said middle section during motion; and wherein said linkage means may be rotated into a detent position where said middle section top is maintained in the same plane as said main body top.

15. A step platform according to claim 14, wherein said riser of said middle section is pivotly attached to said middle section top.

16. A step platform according to claim 15, wherein said linkage means further comprises an adjustable rod pivotly attached on a first end to said middle section riser, and on a second end to said center plate, wherein rotating said linkage means causes said middle section riser to pivot under said middle section.

17. An escalator step, comprising:

a main body, having a top and a riser section;

a middle section, having a top and a riser;

means for selectively maintaining said middle section top in the same plane as said main body top, comprising a first engagement arm, pivotly attached to said main body of said higher step;

a second engagement arm, pivotly attached to said main body of said higher step; and a first link, pivotly attached to said first and second engagement arms, such that rotating one of said engagement arms in a first direction causes the other of said engagement arms to rotate in the opposite direction; and linkage means for connecting said first engagement arm and said middle section.

18. An escalator step according to claim 17, wherein said linkage means comprises:

a center plate;

an engagement arm link, pivotly mounted on a first end to said center plate, and to said first engagement arm on a second end; and a middle section link, pivotly mounted on a first end to said middle section, and to said center plate on a second end;

wherein said linkage means guides said middle section during motion; and wherein said linkage means may be rotated into a detent position where said middle section top is maintained in the same plane as said main body top.

19. A step platform according to claim 18, wherein said riser of said middle section is pivotly attached to said middle section top.

20. A step platform according to claim 19, wherein said linkage means further comprises an adjustable rod pivotly attached on a first end to said middle section riser, and on a second end to said center plate, wherein rotating said linkage means causes said middle section riser to pivot under said middle section.

* * * * *